US005348566A

United States Patent [19]

Sawyer et al.

[11] Patent Number: 5,348,566

[45] Date of Patent: Sep. 20, 1994

[54] METHOD AND APPARATUS FOR FLOW CONTROL IN ELECTROSLAG REFINING PROCESS

[75] Inventors: Thomas F. Sawyer, Stillwater; Mark G. Benz, Burnt Hills; William T. Carter, Jr., Ballston Lake; Robert J. Zabala, Schenectady, all of N.Y.

[73] Assignee: General Electric Company, Schenectady, N.Y.

[21] Appl. No.: 969,905

[22] Filed: Nov. 2, 1992

[51] Int. Cl.[5] ..... B22D 23/00

[52] U.S. Cl. ..... 75/10.24; 75/10.1; 164/53

[58] Field of Search ..... 75/10.24, 10.1; 164/53

[56] References Cited

U.S. PATENT DOCUMENTS

| | | | |
|---|---|---|---|
| 3,519,059 | 7/1970 | Voskobainikov | 164/53 |
| 3,817,503 | 6/1974 | Lafferty et al. | 266/34 R |
| 3,826,301 | 7/1974 | Brooks | 164/5 |
| 3,868,987 | 3/1975 | Galey | 75/10.24 |
| 3,909,921 | 10/1975 | Brooks | 164/5 |
| 3,988,084 | 10/1976 | Esposito et al. | 425/7 |
| 4,575,325 | 3/1986 | Duerig et al. | 425/7 |
| 4,619,597 | 10/1986 | Miller | 425/7 |
| 4,619,845 | 10/1986 | Ayers et al. | 427/422 |
| 4,631,013 | 12/1986 | Miller | 425/7 |
| 4,779,802 | 10/1988 | Coombs | 239/292 |
| 4,801,412 | 1/1989 | Miller | 264/12 |
| 4,926,923 | 5/1990 | Brooks et al. | 164/5 |
| 5,004,153 | 4/1991 | Sawyer | 239/81 |

OTHER PUBLICATIONS

D. J. Chronister, S. W. Scott, D. R. Stickle, D. Eylon, F. H. Froes, "Induction of Skull Melting of Titanium and Other Reactive Alloys," Journal of Metals, Sep. 1986, pp. 51–54.

*Primary Examiner*—Peter D. Rosenberg

*Attorney, Agent, or Firm*—R. Thomas Payne; James Magee, Jr.

[57] ABSTRACT

A method of electroslag refining of metal is taught. The method starts with the introduction of unrefined metal into an electroslag refining process in which the unrefined metal is first melted at the upper surface of the refining slag. The molten metal in the form if droplets is refined as it passes through the molten slag. The refined metal droplets are collected in a cold hearth apparatus having a skull of refined metal formed on the surface of the cold hearth and protecting the cold hearth from the leaching action of the refined molten metal. A cold finger bottom pour spout is formed at the bottom of the cold hearth to permit dispensing of molten refined metal from the cold hearth. The rate of flow of molten metal through the cold finger apparatus is controlled by controlling the rate of melting of the unrefined metal; by controlling the hydrostatic head of molten metal and salt above the bottom pour cold finger orifice; by controlling the rate of induction heat supplied to the metal within the cold finger apparatus; by controlling the rate of heat removal from the metal within the cold finger apparatus through the cold finger apparatus itself and through adjacent gas cooling means; and by applying force to slow down and/or interrupt the flow of metal through the cold finger apparatus.

6 Claims, 5 Drawing Sheets

METHOD AND APPARATUS FOR FLOW CONTROL IN ELECTROSLAG REFINING PROCESS

CROSS-REFERENCE TO RELATED APPLICATIONS

The present invention relates closely to commonly owned applications as follows:

Ser. No. 07/779,773, filed Oct. 21, 1991;
Ser. No. 07/920,075, filed Jul. 27, 1992;
Ser. No. 07/920,066, filed Jul. 27, 1992;
Ser. No. 07/928,581, filed Aug. 13, 1992;
Ser. No. 07/920,078, filed Jul. 27, 1992;
Ser. No. 07/928,596, filed Aug. 13, 1992;
Ser. No. 07/898,609, filed Jun. 15, 1992;
Ser. No. 07/928,595, filed Aug. 13, 1992;
Ser. No. 07/961,942, filed Oct. 16, 1992;
Ser. No. 07/969,906, filed Nov. 2, 1992;
Ser. No. 07/898,602, filed Jun. 15, 1992; and
Ser. No. 07/928,385, filed Aug. 12, 1992.

The texts of the related applications are incorporated herein by reference.

BACKGROUND OF THE INVENTION

The present invention relates generally to control of the flow of refined metal in an ESR-CIG apparatus. The ESR apparatus is an electroslag refining apparatus and the CIG apparatus is a cold wall induction guide tube apparatus, also referred to herein as a cold wall induction guide mechanism and a cold finger nozzle mechanism. More particularly, the invention relates to the control of flow to, through and from the CIG apparatus.

Such control of flow is important to numerous applications which can be made of the refining apparatus including close coupled atomization processing.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt orifice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1,000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy and the closely coupled atomization can result in a larger fraction of additive elements remaining in solid solution. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in predipitated form. Closely coupled atomization is more effective than remotely coupled atomization in producing the small powder sizes which will retain the additive elements in solid solution.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the closely coupled atomization process. This is particularly true for the finer particles of the powder formed from the atomization.

It has been observed with regard to the prior art structures as discussed above relative to the prior art patents that where the superheat in the melt passing through the melt guide tube is at a sufficiently low level, there is a tendency for the molten metal passing through the melt guide tube to form a solid layer of solidified metal against the inner wall of the melt guide tube and eventually to solidify completely, thus blocking melt guide tube and in effect terminating the atomization procedure.

An important aspect of the atomization of metals which melt at high temperatures is means by which the supply of the molten metal to the atomization processing is accomplished. In general, very high specification metal is desirable as is noted above. In part, the high specification pertains to the absence of particulate ceramic material. In addition, the high specification can pertain to a low level of oxides or other contaminants. A novel combination of atomization processing is coupled with a unique molten metal supply to make possible a novel and unique atomization processing. In particular, a closely coupled atomization processing may be combined with an electroslag refining to permit atomization of uniquely high specification molten metal.

By way of providing further background of this novel overall atomization processing the background of a unique electroslag refining method is now provided.

This aspect of the present invention relates generally to direct processing of metal passing through an electroslag refining operation. More specifically, it relates to processing a stream of metal which stream is generated directly beneath an electroslag processing apparatus.

As explained in copending application Ser. No. 07/779,773, filed Oct. 21, 1991, it is known that the processing relatively large bodies of metal, such as superalloys, is accompanied by many problems which derive from the bulky volume of the body of metal itself. Such processing involves problems of sequential heating and forming and cooling and reheating of the large bodies of the order of 5,000 to 35,000 pounds or more in order to control grain size and other microstructure. Such problems also involve segregation of the ingredients of alloys in large metal bodies as processing by melting and similar operations is carried out. A sequence of processing operations is sometimes selected in order to overcome the difficulties which arise through the use of bulk processing and refining operations.

One such sequence of steps involves a sequence of vacuum induction melting followed by electroslag refining and followed, in turn, by vacuum arc refining and followed, again in turn, by mechanical working through forging and drawing types of operations. While the metal produced by such a sequence of steps is highly useful and the metal product itself is quite valuable, the processing through the several steps is expensive and time-consuming.

For example, the vacuum induction melting of scrap metal into a large body of metal of 20,000 to 35,000 pounds or more can be very useful in recovery of the scrap material. The scrap may be combined with virgin metal to achieve a nominal alloy composition desired and also to render the processing economically sound. The size range is important for scrap remelting economics. According to this process, the scrap and other metal is processed through the vacuum induction melting steps so that a large ingot is formed and this ingot has considerably more value than the scrap and other material used in forming the ingot. Following this conventional processing, the large ingot product is usually found to contain one or more of three types of defects and specifically voids, slag inclusions and macrosegregation.

This recovery of scrap into an ingot is the first step in a refining process which involves several sequential processing steps. Some of these steps are included in the subsequent processing specifically to cure the defects generated during the prior processing. For example, such a large ingot may then be processed through an electroslag refining step to remove a significant portion of the oxide and sulfide which may be present in the ingot as a result of the ingot being formed at least in part from scrap material.

Conventional electroslag refining is a well-known process which has been used industrially for a number of years. Such a process is described, for example, on pages 82–84 of a text on metal processing entitled "Superalloys, Supercomposites, and Superceramics". This book is edited by John K. Tien and Thomas Caulfield and is published by Academic Press, Inc. of Harcourt Brace Jovanovich, and bears the copyright of 1989. The use of this electroslag refining process is responsible for removal of oxide, sulfide and other impurities from the vacuum induction melted ingot so that the product of the processing has lower concentrations of these impurities. The product of the electroslag refining is also largely free of voids and slag inclusions.

However, a problem arises in the conventional electroslag refining process because of the formation of a relatively deep melt pool as the process is carried out. The deep melt pool results in a degree of ingredient macrosegregation and in a less desirable microstructure. Defects produced by macrosegregation are visually apparent and are called "freckles". One way to reduce freckles is by reducing the diameter of the formed ingot but such reduction can also adversely affect economics of the processing.

To overcome this deep melt pool problem, a subsequent processing operation is employed in combination with the electroslag refining, particularly to reduce the depth of the melt pool and the segregation and microstructure problems which result from the deeper pool. This latter processing is a vacuum arc refining and it is also carried out by a conventional and well-known processing technique.

The vacuum arc refining starts with the ingot produced by the electroslag refining and processes the metal through the vacuum arc steps to produce a relatively shallow melt pool and to produce better microstructure, and possibly a lower nitrogen content, as a result. Again, for reasons of economic processing, a relatively large ingot of the order of 10 to 40 tons is processed through the electroslag refining and then through the vacuum arc refining. However, the large ingots of this processing has a large grain size and may contain defects called "dirty" white spots.

Following the vacuum arc refining, the ingot of this processing is then mechanically worked to yield a metal stock which has better microstructure. Such a mechanical working may, for example, involve a combination of steps of forging and drawing to lead to a relatively smaller grain size. The thermomechanical processing of such a large ingot requires a large space on a factory floor and requires large and expensive equipment as well as large and costly energy input.

The conventional processing as described immediately above has been found necessary over a period of time in order to achieve the very desirable microstructure in the metal product of the processing. As is indicated above in describing the background of this art, one of the problems is that one processing step results in some deficiency in the product of that step so that another processing step is combined with the first in order to overcome the deficiency of the initial or earlier step in the processing. However, when the necessary combination of steps is employed, a successful and beneficial product with a desirable microstructure is produced. The drawback of the use of this recited combination of processing steps is that very extensive and expensive equipment is needed in order to carry out the sequence of processing steps and further a great deal of processing time and heating and cooling energy is employed in order to carry out each of the processing steps and to go from one step to the next step of the sequence as set forth above.

The processing as described above has been employed in the application of superalloys such as IN-718 and René 95. For some alloys the sequence of steps has led to successful production of alloy billets, the composition and crystal structure of which are within specifications so that the alloys can be used as produced. For other superalloys, and specifically for the René 95 alloy, it is usual for metal processors to complete the sequence of operations leading to specification material by adding the processing through powder metallurgy techniques. Where such powder metallurgical techniques were employed, the first steps in completing the sequence are the melting of the alloy and gas atomization of the melt. This is followed by screening the powder which is produced by the atomization. An alternative to conventional atomization is desirable and the present teaching provides a metal melt supply and flow control adapted to such alternative and superior atomization processing known as close coupled atomization.

According to prior art practice the selected fraction of the screened powder is then conventionally enclosed within a can of soft steel, for example, and the can is HIPed to consolidate the powder into a useful form. Such HIPing may be followed by extruding or other conventional processing steps to bring the consolidated product to a useable form.

Another alternative to the conventional powder metallurgy processing as described immediately above is an alternative conventional process known as spray forming. Spray forming has been described in a number of patents including the U.S. Pat. Nos. 3,909,921; 3,826,301; 4,926,923; 4,779,802; 5,004,153; as well as a number of other such patents.

In general, the spray forming process has been gaining additional industrial use as improvements have been made in processing, particularly because it involves fewer steps and has a cost advantage over conventional powder metallurgy techniques so there is a tendency toward the use of the spray forming process where it yields products which are comparable and competitive with the products of the conventional powder metallurgy processing.

For each of these processes a good supply of high temperature metal is needed and the subject process provides such a supply as well as methods of controlling flow of the melt.

BRIEF STATEMENT OF THE INVENTION

In one of its broader aspects, objects of the invention can be achieved by providing an ingot electrode having nonspecification chemistry and microstructure, introducing the ingot into an electroslag refining vessel containing molten slag to make electric contact between the ingot and the slag in said vessel, passing a high electric current through the ingot electrode and slag to cause the ingot to resistance melt at the surface where it contacts the slag and to cause droplets of ingot formed from such melting to pass down through the slag and to be refined as they pass through the slag, collecting the descending molten metal in a cold hearth reservoir positioned beneath the electroslag refining vessel, providing a funnel shaped cold wall induction guide mechanism having a bottom pour spout at the bottom of the cold hearth apparatus to permit refined molten metal to pass through the spout as a stream, providing induction coil means for induction heating of the cone shaped interior of said cold wall mechanism, providing a flow of said melt from said reservoir to and through said mechanism to form a stream of melt exiting the bottom pour spout of said mechanism, reducing the induct ion heating power supplied to said mechanism to reduce the degree of heating of the melt passing through said mechanism, increasing the cooling applied to the individually cooled fingers of said cold wall guide tube mechanism to induce cooling of the melt passing through said mechanism and to induce cooling of the molten metal within the narrow vertical neck like passageway of said mechanism whereby the metal within said passageway freezes and flow of the molten metal through said passageway is temporarily terminated.

The present invention in another of its broader aspects may be accomplished by an apparatus which comprises electroslag refining apparatus comprising a metal refining vessel adapted to receive and to hold a metal refining molten slag, means for positioning an electrode in said vessel in touching contact with said molten slag, electric supply means adapted to supply refining current to said electrode and through said molten slag to the metal refining vessel and to keep said refining slag molten, means for advancing said electrode toward said molten slag at a rate corresponding to the rate at which the electrode is consumed as the refining thereof proceeds, a cold hearth beneath said metal refining vessel, said cold hearth being adapted to receive and to hold electroslag refined molten metal in contact with a solid skull of said refined metal in contact with said cold hearth, a funnel shaped cold wall induction guide mechanism below said cold hearth adapted to receive and to dispense as a stream molten metal processed through said electroslag refining process and through said cold hearth, reducing the induction heating power supplied to said mechanism to reduce the degree of heating of the melt passing through said mechanism, increasing the cooling applied to the individually cooled fingers of said cold wall induction guide mechanism to induce cooling of the melt passing through said mechanism and to induce the cooling of molten metal within the passageway of said mechanism whereby the metal within said passageway freezes and flow of the molten metal through said passageway is temporarily terminated.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

The method of the present invention is carried out by introducing an electrode or ingot of metal to be refined directly into an electroslag refining apparatus and refining the metal to produce a melt of refined metal which is received and retained within a cold hearth apparatus mounted immediately below the electroslag refining apparatus. The molten metal is dispensed from the cold hearth through a cold finger orifice mounted directly below the cold hearth reservoir. The flow of melt from the cold finger apparatus is controlled by one or by a combination of mechanisms including thermal and mechanical means.

If the rate of electroslag refining of metal and accordingly the rate of delivery of refined metal to a cold hearth approximates the rate at which molten metal is drained from the cold hearth through the cold finger orifice, an essentially steady state operation is accomplished in the overall apparatus and the process can operate continuously for an extended period of time and, accordingly, can process a large bulk of unrefined metal to refined metal.

As the metal is drained from the cold hearth through the cold finger orifice, a very important aspect of the invention is that it effectively eliminates many of the bulk processing operations such as those described in the background statement above and which, until now, have been necessary in order to produce a metal product having a desired set of properties and microstructure.

The processing described herein is applicable to a wide range of alloys which can be processed beneficially through the electroslag refining processing. Such alloys include nickel- and cobalt-based superalloys, zirconium and titanium-based alloys, and ferrous-based alloys, among others. The slag used in connection with such metals will vary with the metal being processed and will usually be the slag conventionally used with a particular metal in the conventional electroslag refining thereof.

The several processing techniques may be combined to produce a large body of refined metal because the ingot which can be processed through the combined electroslag refining and cold hearth and cold finger mechanism can be a relatively large supply ingot and can, accordingly, produce a continuous stream of metal exiting from the cold finger orifice over a prolonged period to deliver a large volume of molten metal.

It will be understood that the combination of electroslag refining taken together with the cold hearth retention and the cold finger draining of the cold hearth is a novel apparatus and process by itself as explained more fully in copending application Ser. No. 07/779,773.

Figure 1:
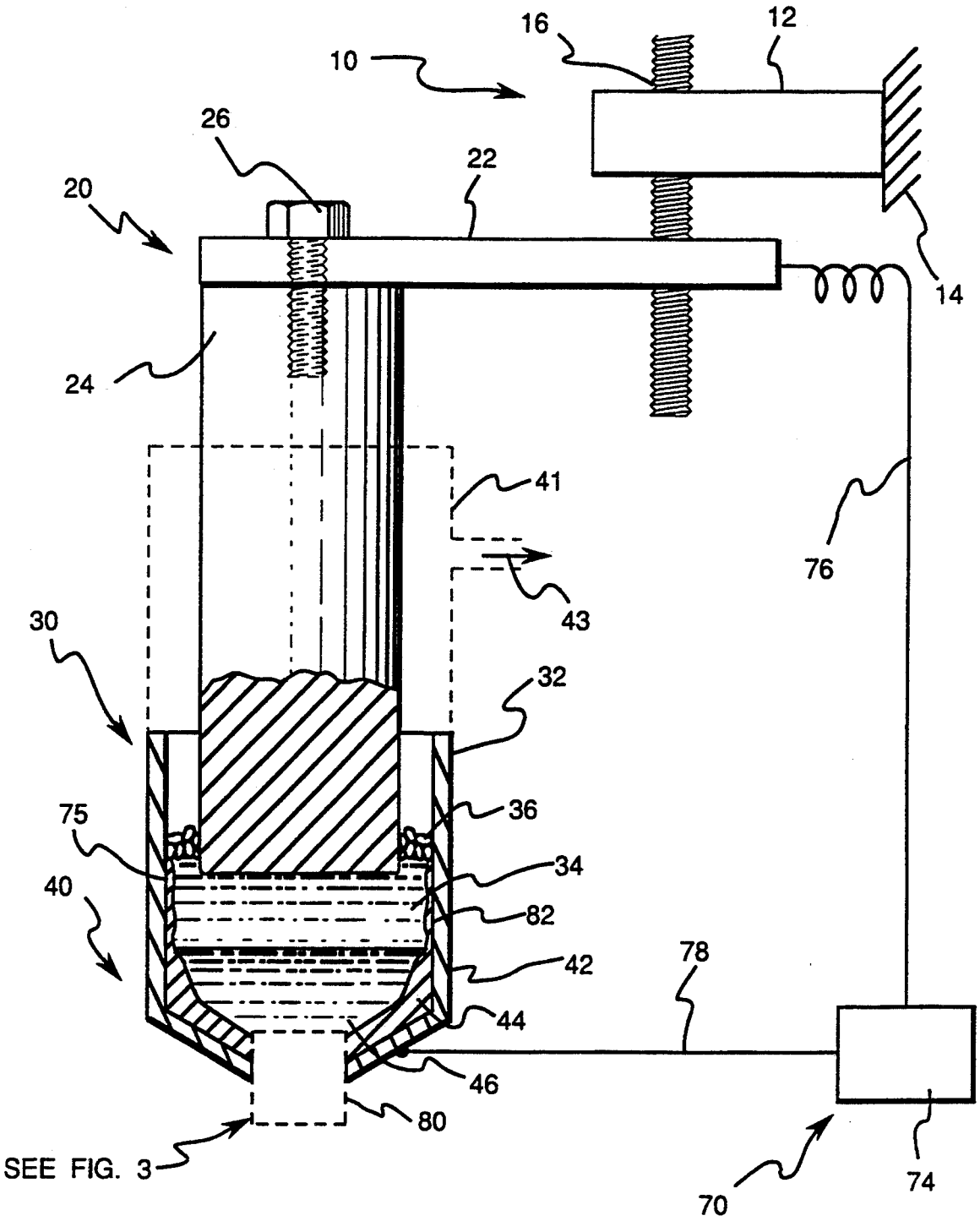
FIG. 1 is a semischematic vertical sectional view of an apparatus suitable for carrying out the present invention.
Figure 2:
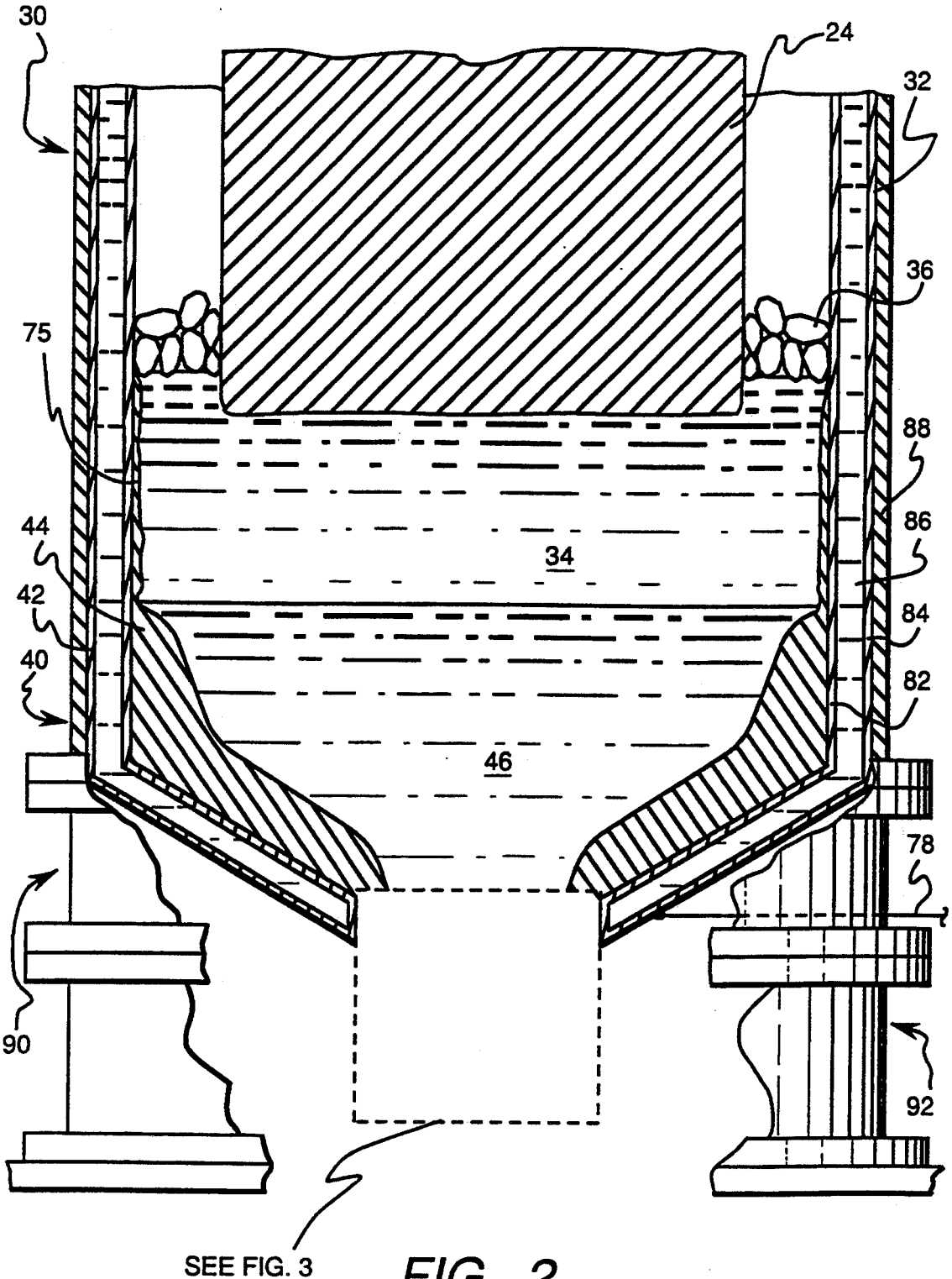
FIG. 2 is a semischematic vertical sectional illustration of an apparatus such as that illustrated in FIG. 1 but showing more structural detail than is presented in FIG. 1.

Referring now particularly to the accompanying drawings, FIGS. 1 and 2 are semischematic elevational views in part in section of a number of the essential and auxiliary elements of apparatus for carrying out the electroslag refining aspect of the present invention. Referring now, first, to FIGS. 1 and 2, there are a number of processing stations and mechanisms and these are described starting at the top.

A vertical motion control apparatus 10 is shown schematically. It includes a box 12 mounted to a vertical support 14 and containing a motor or other mechanism adapted to impart rotary motion to the screw member 16. An ingot support station 20 comprises a bar 22 threadedly engaged at one end to the screw member 16 and supporting the ingot 24 at the other end by conventional bolt means 26.

An electroslag refining station 30 comprises a water cooled reservoir 32 containing a molten slag 34 an excess of which is illustrated as the solid slag granules 36. A skull of slag 75 may form along the inside surfaces of the inner wall 82 of vessel 32 due to the cooling influence of the cooling water flowing against the outside of inner wall 82.

A cold hearth station 40 is mounted immediately below the electroslag refining station 30 and it includes a water cooled hearth 42 containing a skull 44 of solidified refined metal and also a body 46 of liquid refined metal. Water cooled reservoir 32 may be formed integrally with water cooled hearth.

Figure 3:
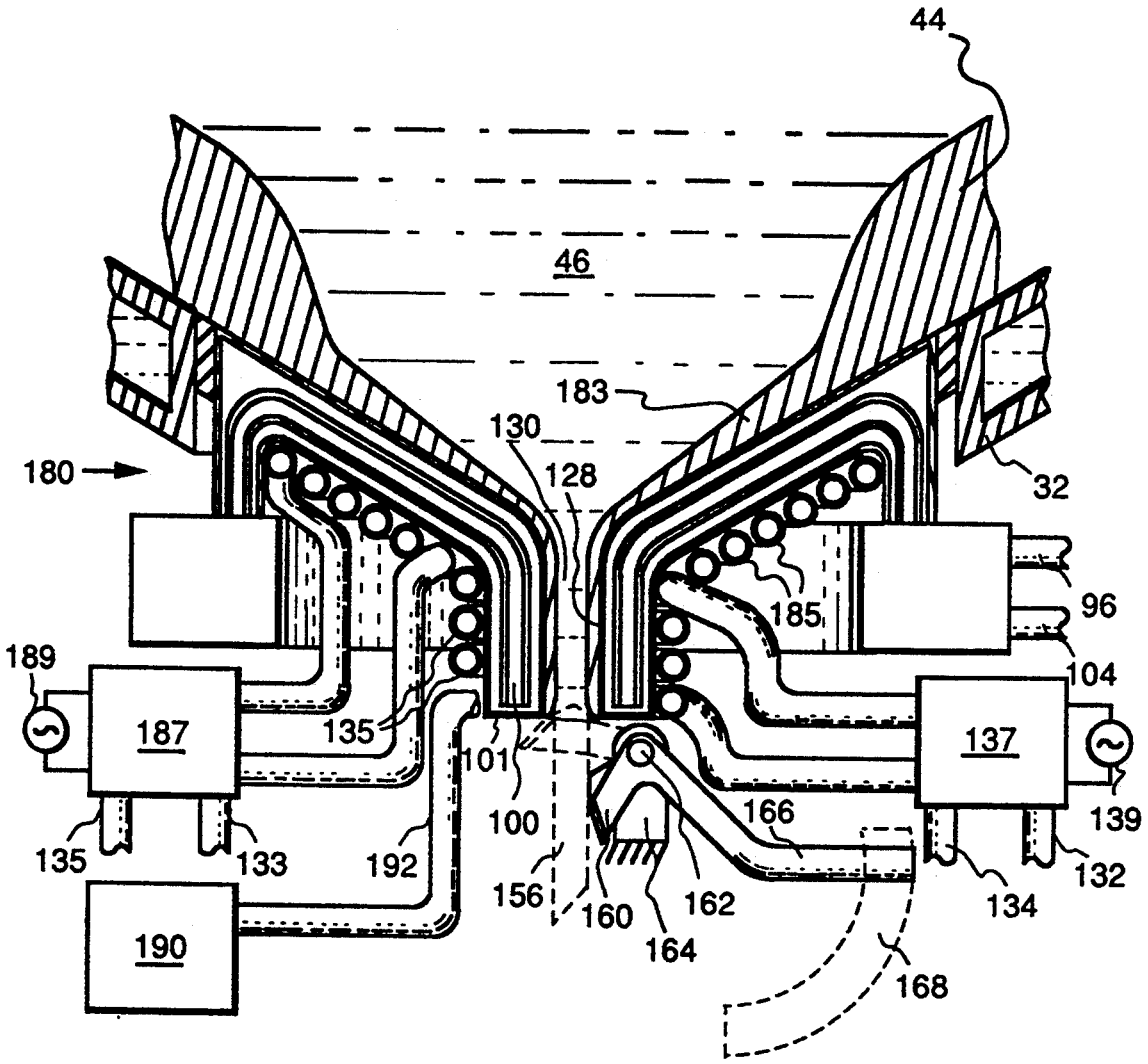
FIG. 3 is a semischematic vertical section in detail of the cold finger nozzle not shown in portions of the structures of FIG. 1 and FIG. 2.

The bottom dispense structure (shown as an empty dashed box) 80 of the apparatus is provided in the form of a cold finger orifice which is described more fully with reference to FIGS. 3. A cold hearth dispensing station 180 and cold finger orifice are provided as explained more fully with reference to FIG. 3.

Electric refining current is supplied by station 70. The station includes the electric power supply and control mechanism 74. It also includes the conductor 76 carrying current to the bar 22 and, in turn, to ingot 24. Conductor 78 carries current to the metal vessel wall 32 to complete the circuit of the electroslag refining mechanism.

Referring now more specifically to FIG. 2, this FIGURE is a more detailed view of stations 30, and 40 of FIG. 1. In general, the reference numerals as used in FIG. 2 correspond to the reference numerals as used in FIG. 1 so that like parts bearing the same reference numeral in each FIGURE have essentially the same construction and function.

Similarly, the same reference numerals are used with respect to the same parts in the still more detailed view of FIGS. 3 and 4 discussed more thoroughly below.

As indicated above, FIG. 2 illustrates in greater detail the electroslag refining vessel, the cold hearth vessel, and the various apparatus associated with this vessel.

As indicated by FIG. 2, the station 30 is an electroslag refining station disposed in the upper portion 32 of the vessel and the cold hearth station 40 is disposed in the lower portion 42 of the vessel. The vessel is a double walled vessel having an inner wall 82 and an outer wall 84. Between these two walls, a cooling liquid such as water is provided as is conventional practice with some cold hearth apparatus. The cooling water 86 may be flowed to and through the flow channel between the inner wall 82 and outer wall 84 from supply means and through conventional inlet and outlet means which are conventional and which are not illustrated in the FIGURE. The use of cooling water, such as 86, to provide cooling of the walls of the cold hearth station 40 is necessary in order to provide cooling at the inner wall 82 and thereby to cause the skull 44 to form on the inner surface of the cold hearth structure. The cooling water 86 is not essential to the operation of the electroslag refining or to the upper portion of the electroslag refining station 30 but such cooling may be provided to insure that the liquid metal 46 will not make contact with the inner wall 82 of the containment structure because the liquid metal 46 could attack the wall 82 and cause some dissolution therefrom to contaminate the liquid metal of body 46 within the cold hearth station 40.

In FIG. 2, a structural outer wall 88 is also illustrated. Such an outer wall may be made up of a number of flanged tubular sections. Two such sections 90 and 92 are illustrated in the bottom portion of FIG. 2.

The cold finger and close coupled atomization structure is not shown in FIG. 2 or in FIG. 1 as the detail is too great to be clearly illustrated. However, the structural detail omitted from FIGS. 1 and 2 is illustrated in, and is now described with reference to, FIGS. 3 and 4 in which the cold finger structure is shown in detail.

Figure 4:
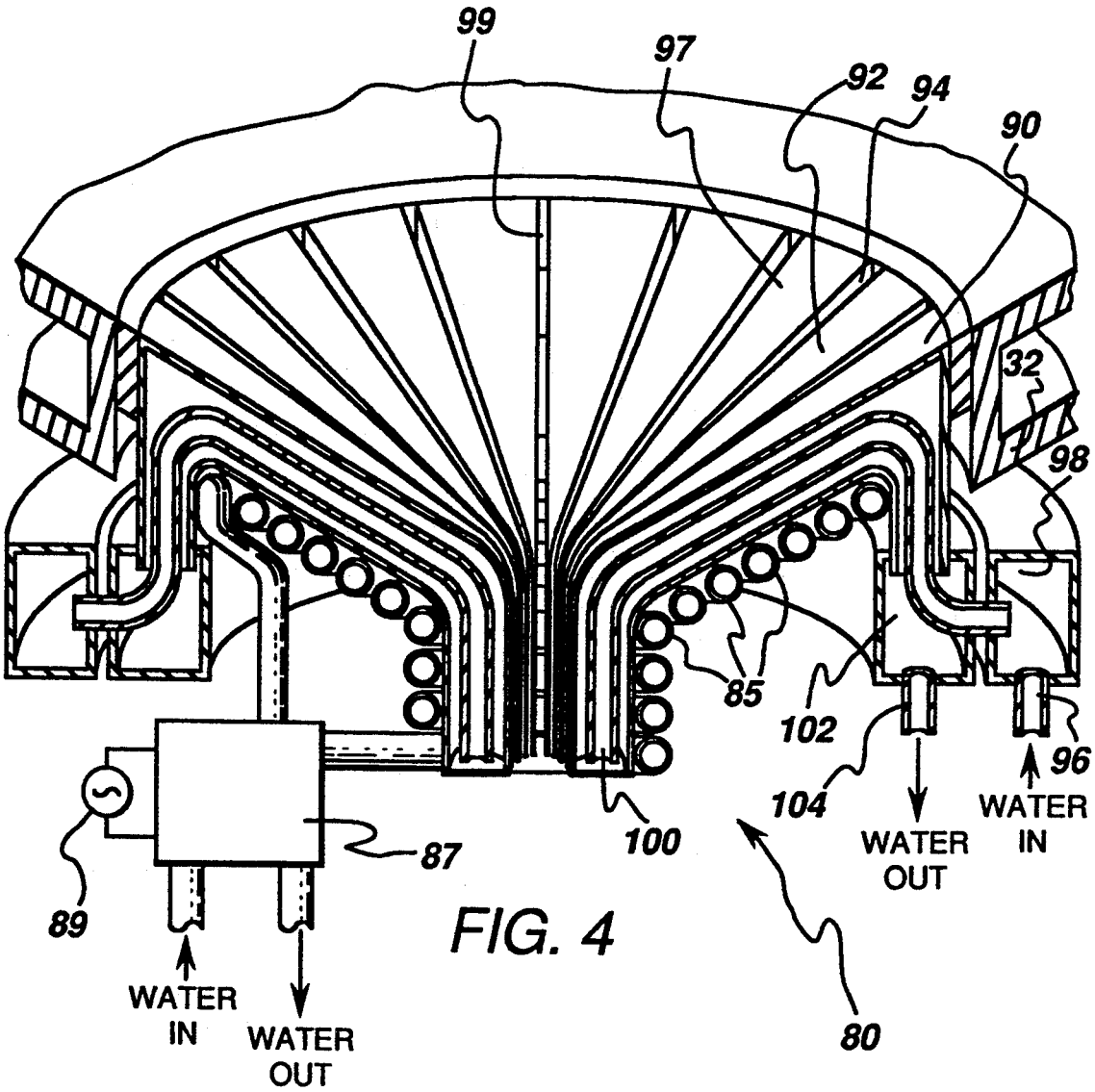
FIG. 4 is a semischematic illustration in part in section of the cold finger nozzle portion of an apparatus similar to that illustrated in FIG. 3 but showing the apparatus free of molten metal.

Referring now, particularly to FIGS. 3 and 4, the cold finger structure is shown in detail in FIG. 3 in its relation to the processing of the metal from the cold hearth structure and the delivery of liquid melt 46 from the cold hearth station 40 as illustrated in FIGS. 1 and 2. The illustration of FIG. 3 shows the cold finger with the solid metal skull and with the liquid metal reservoir in place. By contrast, FIG. 4 illustrates the cold finger structure without the liquid metal, or solid metal skull in order that more structural details may be provided and clarity of illustration may be gained in this way.

Cold finger structures of a general character are not themselves novel structures but have been described in the literature. The Duriron Company, Inc., of Dayton, Ohio, has published a paper in the *Journal of Metals* in Sep. 1986 entitled "Induction Skull Melting of Titanium and Other Reactive Alloys" by D.J. Chronister, S.W. Scott, D.R. Stickle, D. Eylon, and F.H. Froes. In this paper, an induction melting crucible for reactive alloys is described and discussed. In this sense, it may be said that through the Duriron Company a ceramicless melt system is available as it is from other sources.

As the Duriron Company article acknowledges, their scheme for melting metal is limited by the volume capacity of their segmented melt vessel. Periodic charging of their vessel with stock to be melted is necessary. It has been found that a need exists for continuous streams of molten metal which goes beyond the limited capacity of vessels such as that taught by the Duriron article. In copending application Ser. No. 07/732,893, filed Jul. 19, 1991, a description is given of a cold finger crucible having a bottom pour spout. The information in that application is incorporated herein by reference.

In addition, cold finger apparatus having a bottom pour spout similar to that illustrated in FIGS. 3 and 4 is available from Leybold Technology, Inc. of Enfield, Connecticut.

A different structure than that disclosed in either the Duriron Company article or in copending application Ser. No. 07/732,893 has been devised and this structure is disclosed in copending application Ser. No. 779,773. Reference above, our structure combines a cold hearth with a cold finger orifice so that the cold finger structure effectively forms part, and in the illustration of FIG. 3 the center lower part, of the cold hearth. In making this combination, we have preserved the advantages of the cold hearth mechanism which permits the purified alloy to form a skull by its contact with the cold hearth and thereby to serve as a container for the molten version of the same purified alloy. In addition, we have employed the cold finger orifice structure of station 180 of FIG. 3 to provide a more controllable generally funnel shaped skull 183 and particularly of a smaller thickness on the inside surface of the cold finger structure. As is evident from FIG. 3, the thicker skull 44 in contact with the cold hearth and the thinner skull 183 in contact with the generally funnel shaped cold finger structure are essentially continuous.

One reason why the skull 183 is thinner than 44 is that a controlled amount of heat may be put into the skull 183 and into the generally cone shaped portion of the liquid metal body 46 which is proximate the skull 183 by means of the induction heating coils 185. The induction heating coil 185 is water cooled by flow of a cooling water through the coolant and power supply 187. Induction heating power supplied to the unit 187 from a power source 189 is shown schematically in FIG. 3. One significant advantage of the cold finger construction of the structure of station 180 is that the heating effect of the induction energy penetrates through the cold finger structure and acts on the body of liquid metal 46 as well as on the skull structure 183 to apply heat thereto. This is one of the features of the cold finger structure and it depends on each of the fingers of the structure being insulated from the adjoining fingers by an air or gas gap or by an insulating material. Hence the term CIG or cold wall induction guide tube mechanism. This arrangement is shown in clearer view in FIG. 4 where both the skull and the body of molten metal is omitted from the drawing for clarity of illustration. An individual cold finger 97 in FIG. 4 is separated from the adjoining finger 92 by a gap 94 which gap may be provided with and filled with an insulating material such as a ceramic material or with an insulating gas. The molten metal held within the cold finger structure of station 180 does not leak out of the structure through the gaps such as 94 because the skull 183, as illustrated in FIG. 3, forms a bridge over the various cold fingers and prevents and avoids passage of liquid metal therethrough. As is evident from FIG. 4, all gaps extend down to the bottom of the cold finger structure. This is evident in FIG. 4 as gap 99 aligned with the line of sight of the viewer is shown to extend all the way to the bottom of the cold finger structure of station 180. The actual gaps can be quite small and of the order of 20 to 50 mils so long as they provide good insulating separation of the fingers.

Because it is possible to control the amount of heating and cooling passing from the induction coils 185 to and through the cold finger structure of station 180, it is possible to adjust the amount of heating or cooling which is provided through the cold finger structure both to the skull 183 as well as to the generally cone shaped portion of the body 46 of molten metal in contact with the skull.

Referring now again to FIG. 4, the individual fingers such as 90 and 92 of the cold finger structure are provided with a cooling fluid such as water by passing water into the receiving pipe 96 from a source not shown, and around through the manifold 98 to the individual cooling tubes such as 100. Water leaving the end of tube 100 flows back between the outside surface of tube 100 and the inside surface of finger 90 to be collected in manifold 102 and to pass out of the cold finger structure through water outlet tube 104. This arrangement of the individual cold finger water supply tubes such as 100 and the individual separated cold fingers such as 90 is essentially the same for all of the fingers of the structure so that the cooling of the structure as a whole is achieved by passing water in through inlet pipe 96 and out through outlet pipe 104. The general funnel like shape of the CIG (cold wall induction guide tube) structure is readily evident from FIG. 4.

The net result of this action is seen best with reference to FIG. 3 where a stream 156 of molten metal is shown (in phantom) exiting from the cold finger orifice structure. This flow is maintained when a desirable balance is achieved between the input of cooling water and the input of heating electric power to and through the induction heating coils 185 and 135.

The cooling water which enters each finger of the cold finger structure flows in a manner best illustrated and described with reference to FIG. 4 above. A similar flow occurs in the structure illustrated in FIG. 3 although the illustration of FIG. 3 is more schematic than that shown in FIG. 4. The inlet pipe 96 and outlet pipe 104 are shown with different orientation in FIG. 3 than in FIG. 4 for convenience of illustration.

The induction heating coils 85 of FIG. 4 show a single set of coils operating from a single power supply 87 supplied with power from the power source 89. In the structure of FIG. 3 two induction heating coils are employed, the first of which is placed adjacent the tapered portion of the funnel shaped cold finger device and supplies heat principally to the controllable skull 183. A power source 189 supplies power to power supply 187 and this power supply furnishes the power to the set of coils 185 positioned immediately beneath the tapered portion of the funnel shaped cold finger structure. A second power source 139 furnishes power to power supply 137 and power is supplied from the source 137 to a set of coils 135 which are positioned along the vertical down spout portion of the cold finger apparatus to permit a control of the flow of molten metal from bath 46 through the vertical portion of the cold finger apparatus.

An increase in the amount of induction heating through coil 135 can cause a remelting of the solidified plug of metal in the vertical portion of the cold finger apparatus and a renewal of stream 156 of molten metal through passageway 130. When the stream 156 is stopped or slowed, there is a corresponding growth and thickness of the skull 128 in the vertical portion or neck of the funnel shaped cold finger apparatus. The regulation of the amount of cooling water flowing to the cold finger apparatus itself as well as the flow of induction heating current through the coils 185 and 135 and particularly the coil 135 regulates the thickness of the thinner skull 128 and the thickness of skull 128 is one of several parameters which regulates the rate of flow of metal from the reservoir 46.

As it has been noted above when the rate of flow of metal from the cold hearth station 40 through the cold finger mechanism 180 is reduced it is necessary to reduce also the flow of the refining current passing through the body of refined metal 46 as well as through the slag 34 and through the electrode 24. Such reduction in refining current has the effect of reducing the rate of melting of the ingot 24 at the upper surface of the slag 34 and in this way reducing the rate at which metal accumulates in the cold hearth 40.

When the flow of stream 156 is brought to a stop through the enlargement of the thickness of the skull 128 in the vertical neck portion of the cold finger apparatus the liquid metal 46 in the cold hearth as well as the liquid salt 34 and the slag station can be kept molten by passing a current through the apparatus in the manner described above but at a sufficiently low level that the reservoir 46 of molten remains molten and the slag bath 34 remains molten but the melting of the electrode at the upper surface of the slag bath 34 proceeds at a very low or negligible level so that the level of molten metal in cold hearth station 40 does not build up excessively.

In operation, the apparatus may best be described with reference, now, again to FIG. 1.

One feature is illustratively shown in FIG. 1. This feature concerns the throughput capacity of the apparatus. As is indicated, the ingot 24 of unrefined metal may be processed in a single pass through the electroslag refining and related apparatus and through the cold hearth station 40 to form a continuous stream 156 of refined metal. Very substantial volumes of metal can be processed through the apparatus because the starting ingot 24 has a relatively small concentration of impurities such as oxide, sulfides, nitrides and the like, which are to be removed by the electroslag refining process. The stream 156 of FIG. 3 formed by the processing as illustrated in FIGS. 1 and 2 is a stream of refined metal and is free of the oxide, sulfide and other impurities which can be removed by the electroslag refining of station 30 of the apparatus of FIG. 1. It is, of course, possible to process a single relatively large scale ingot through the apparatus and to weld the top of ingot 24 to the bottom of a superposed ingot to extend the processing of ingots through the apparatus of FIG. 1 to several successive ingots. The term ingot as used herein designates one form of electrode which can be processed. Other forms of electrode, such as compacted scrap metal and the like, can also be processed. Such ingots can be of 8 to 24 inches in diameter.

Depending on the application to be made of the electroslag refining apparatus as illustrated in FIG. 1, there is established a need to control the rate at which a metal stream such as 156 is removed from the cold finger orifice structure 180.

Figure 5:
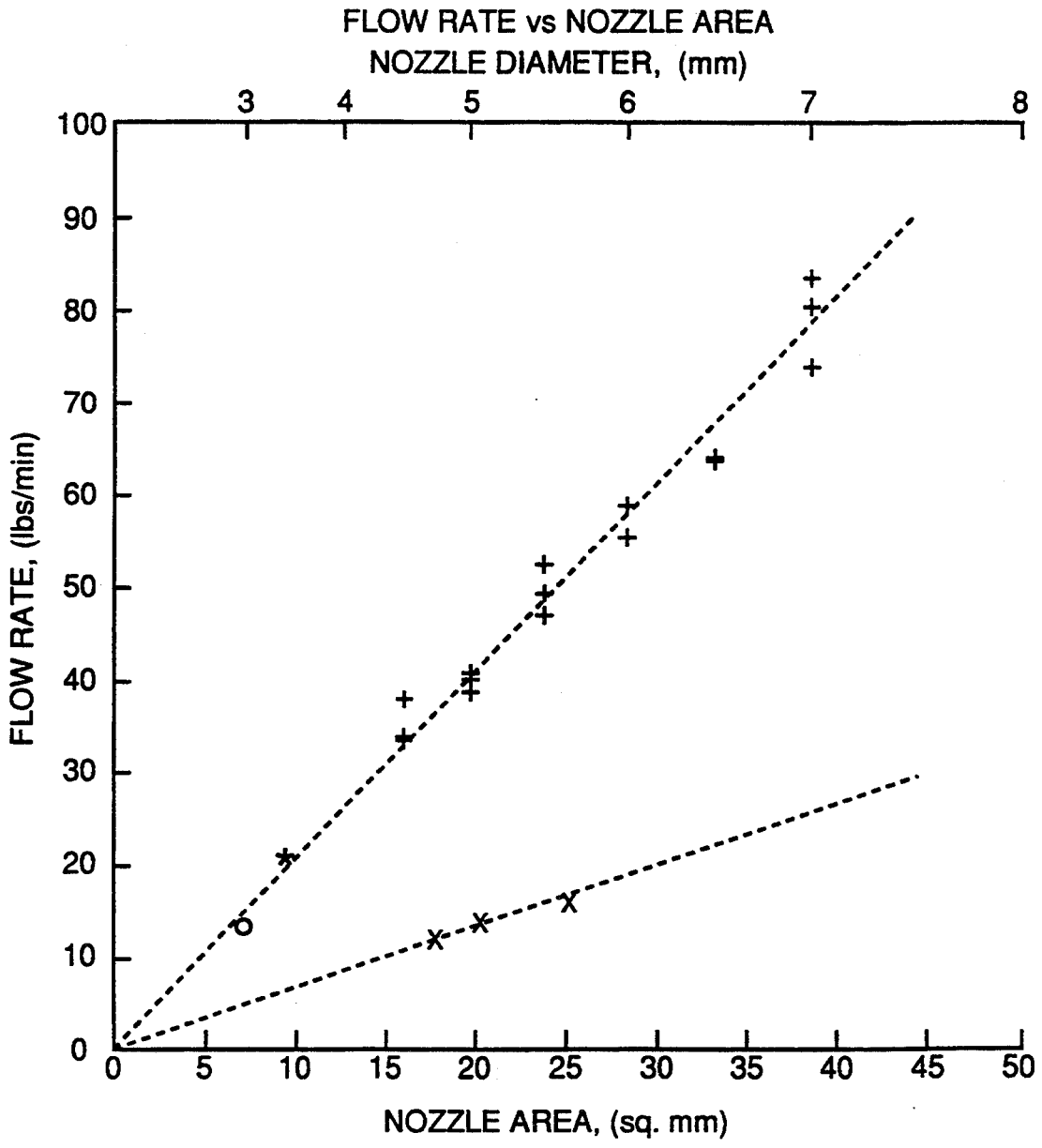
FIG. 5 is a graph in which flow rate in pounds per minute is plotted against the area of the nozzle opening in square millimeters for two different heads of molten metal and specifically a lower plot for a head of about 2 inches and an upper plot for a head of about 10 inches of molten metal.

The rate at which such a stream of molten metal may be drained from the cold hearth through the cold finger structure 180 is controlled by the cross-sectional area of the orifice and by the hydrostatic head of liquid above the orifice. This hydrostatic head is the result of the column of liquid metal and of liquid salt which extends above the orifice of the cold finger structure 180. The flow rate of liquid from the cold finger orifice or nozzle has been determined experimentally for a cylindrical orifice. This relationship is shown in FIG. 5 for two different hydrostatic head heights. The lower plot defined by X's is for a two inch head of molten metal and the upper plot defined by +'s and o's is for a 10 inch head of molten metal. In this FIGURE, the flow rate of metal from the cold finger nozzle is given on the ordinate in pounds per minute. Two abscissa are shown in the FIGURE—the lower is the nozzle area in square millimeters and the upper ordinate is the nozzle diameter in millimeters. Based on the data plotted in this FIGURE, it may be seen that for a nozzle area of 30 square millimeters, the flow rate in pounds per minute was found to be approximately 60 pounds per minute for the 10 inch hydrostatic head. For the 2 inch hydrostatic head, this nozzle area of 30 square millimeters gave the flow rate of approximately 20 pounds per minute.

What is made apparent from this experiment is that if a electroslag refining apparatus, such as that illustrated in FIG. 2, is operated with a given hydrostatic head, that a nozzle area can be selected and provided which permits an essentially constant rate of flow of liquid metal from the refining vessel so long as the hydrostatic head above the nozzle is maintained essentially constant. It is deemed that it can be important in the operation of such an apparatus to establish and maintain an essentially constant hydrostatic head. To provide such a constant hydrostatic head, it is important that the electroslag refining current flowing through the refining vessel be such that the rate of melting of metal from the ingot such as 24 be adjusted to provide a rate of melting of ingot metal which corresponds to the rate of withdrawal of metal in stream 156 from the refining vessel. In this way maintenance of a constant hydrostatic head of two inches or more can achieved.

In other words, one control on the rate at which the metal from ingot 24 is refined in the apparatus of FIG. 1 is determined by the level of refining power supplied to the vessel from a source such as 74 of FIG. 1. Such a current may be adjusted to values between about 2,000 and 20,000 amperes. A primary control, therefore, in adjusting the rate of ingot melting and, accordingly, the rate of introduction of metal into the refining vessel is the level of power supply to the vessel. In general, a steady state is desired in which the rate of metal melted and entering the refining station 30 as a liquid is equal to the rate at which liquid metal is removed as a stream 156 (see FIG. 3) through the cold finger structure. Slight adjustments to increase or decrease the rate of melting of metal are made by adjusting the power delivered to the refining vessel from a power supply such as 74. Also, in order to establish and maintain a steady state of operation of the apparatus, the ingot must be maintained in contact with the upper surface of the body of molten salt slag 34 and the rate of descent of the ingot into contact with the melt must be adjusted through control means within box 12 to ensure that touching contact of the lower surface of the ingot with the upper surface of the molten slag 34 is maintained.

The deep melt pool 46 within cold hearth station 40, which is described in the background statement above as a problem in the conventional electrorefining processing, is found to be an advantage in the electroslag refining of the subject invention.

The explanation above is how a specific flow rate can be established from the reservoir of melt 46 through the flow path 130 (see FIG. 3) from the cold finger apparatus 180. It will be appreciated that when a relatively short run of melt from the apparatus is desired it will be also desirable to have the capability of terminating the flow. This can be accomplished in a number of ways. Generally, the stoppage of flow through passageway 130 is accomplished by withdrawing heat from the melt and essentially freezing the metal within the passageway 130. In doing this it will be appreciated that there are essentially two sources of heat for the metal within passageway 130. One source is heat which is generated in the metal by operation of the coils 135 and 185. The second source is the heat within the melt itself as it flows down from reservoir 46. Although it is possible to stop heating the melt in passageway 130 by stopping the supply of power from power source 137 the metal will remain molten because molten metal is flowing down reservoir 46 to passageway 130 and brings with it the heat of fusion and a degree of superheat already present in the melt.

There are also a number of ways in which heat is removed from melt in passageway 130. A primary source of heat removal and the one which causes the skull 128 to remain in place is the cooling accomplished by flow of water in the cold fingers, such as 100. It is possible to increase or reduce the rate of cooling water flow through the cold fingers in order to increase or decrease the size of the skull 128.

In addition, a source 190 of cold gas is provided and a gas supply pipe 192 is disposed to direct the gas against the bottom surface 101 of the cold finger apparatus 180. As is well known, high pressure gas from such as 190 will expand as it leaves the end of pipe 192 and will become spontaneously cooled to low temperatures of minus 200 degrees centigrade or lower. Such high pressure gas cooling of the neck of the CIG structure can be very effective in rapidly removing heat from the structure and causing a freeze up of melt in the passageway 130 through the neck.

There are accordingly a number of ways in which heat can be removed from molten metal in passageway 130 in order to freeze metal in the passageway and block further flow through the passageway. Depending on the hydrostatic head within the cold hearth 40 and the hydrostatic head of slag in the station 30 there will be greater or smaller tendency of metal to continue flowing through passageway 130. Where the hydrostatic head is relatively small the blockage of passageway 130 can be achieved simply by withdrawal of heat combined with reduction of induction heating from power unit 137. Where the hydrostatic is higher there is an advantage in being able to accomplish a momentary stoppage of the flow of metal through passageway 130. For this purpose, induction heating from coil 135 is stopped and a mechanical arm positioned below the station 180 is activated and employed. The moveable arm 160 pivots on a pivot pin 162 and the pivot pin is supported from support 164. Arm 160 is moved by movement of handle 166 and the movement of the handle can be accomplished by the remotely activated pivot mechanism 168 shown in phantom. When the arm 166 is moved through the are of the pivot mechanism 168, the arm 160 is brought up to the position, shown in phantom in the FIGURE, and the stream 156, also shown in phantom, is terminated momentarily. While the flow is terminated, the molten metal residing in passageway 130 is frozen and this essentially blocks passage of metal through and from passageway 130. One other way in which the flow of metal through passageway 130 can be reduced is by placing a negative pressure on the electroslag refining station 30 and the cold hearth station 40. This may be accomplished as indicated in FIG. 1 by providing an enclosure such as enclosure 41 shown in phantom above station 30 and exhausting gas from the enclosed structure in the direction of arrow 43. In general, the hydrostatic head above the flow path 130 is lower when a run is completed and the hydrostatic head is at a lower value so that the application of relatively small negative pressure in the enclosure 41 can reduce the flow through passageway 130 and permit the cooling to cause a freeze-up of blockage of the passageway 130.

It will be appreciated that the cooling means as discussed above can be used in combinations so that the freeze-up of metal within passageway 130 can be accomplished.

When it is sought to restart the flow of metal within the passageway 130 the cooling is reduced and induction heating through coil 135 is increased in order to unplug or unclog the passageway 130.

What is claimed is:

1. A method of controlling the flow of melt from a cold wall induction guide tube during electroslag refining comprising the steps of:

providing a cold wall induction guide tube mechanism;

providing a reservoir for the melt;

providing a flow of the melt to and through the mechanism to form a stream exiting the mechanism; and directing a jet of gas, relative cooler than the melt, at the mechanism such that the melt stream is frozen in the mechanism whereby the flow of melt from the mechanism is stopped.

2. The method of claim 1 wherein the gas expands proximate the melt.

3. The method of claim 1 wherein the gas is argon or helium.

4. A method for controlling the flow of melt from a cold wall induction guide tube mechanism during electrogslag refining comprising the steps of:

providing a cold wall induction guide tube mechanism having coolant flowing in the walls thereof;

providing for controllable induction heating of the mechanism, providing a reservoir for the melt operatively positioned relative to the mechanism;

providing a flow of melt to and through mechanism to form a stream exiting the mechanism;

reducing the induction heating provided to the mechanism for reducing the temperature of the melt passing through the mechanism while maintaining the flow of coolant in the mechanism;

providing an element adapted for movement into and out of the path of the melt at the location the melt exists the mechanism; and moving the element into the melt stream for impeding the flow of melt therefrom, such that the flow of melt in the mechanism is slowed and the melt freezes up interrupting the flow of melt from the mechanism.

5. The method of claim 4 wherein the coolant is water.

6. A method for controlling the flow of melt from a cold wall induction guide tube mechanism during electroslag refining comprising the steps of:

providing a cold wall induction guide tube mechanism having a generally funnel shaped open interior for receiving and dispensing liquid metal at a stream from the neck portion thereof, the mechanism having a pour spout and a central passageway defined by a plurality of individually water cooled fingers operatively disposed to admit electric current to the passageway for producing a rapidly changing magnetic field for generating a secondary current in metal within the passageway so as to heat the metal;

providing induction coil means for induction heating of the mechanism;

reducing the induction heating power supplied to the mechanism for cooling the melt passing through the mechanism; and increasing the cooling applied to the individually cooled fingers of the mechanism for cooling the melt passing through the mechanism and for cooling the molten metal within the passageway of the mechanism such that the melt within the passageway freezes and flow of the melt through the passageway is terminated.

* * * * *